US005165375A

United States Patent [19]

Hu

[11] Patent Number: 5,165,375

[45] Date of Patent: Nov. 24, 1992

[54] MASTER PISTON FOR A COMPRESSION RELEASE ENGINE RETARDER

[75] Inventor: Haoran Hu, Windsor, Conn.

[73] Assignee: Jacobs Brake Technology Corporation, Wilmington, Del.

[21] Appl. No.: 816,663

[22] Filed: Jan. 3, 1992

[51] Int. Cl.[5] ..... F02D 13/04

[52] U.S. Cl. ..... 123/321; 92/187; 92/130 R

[58] Field of Search ..... 123/321, 324; 92/107, 92/187, 130 R, 179

[56] References Cited

U.S. PATENT DOCUMENTS 2,847,261 8/1958 Cornelius ..... 92/179
3,220,392 11/1965 Cummins ..... 123/321
4,381,179 4/1983 Paraja ..... 98/187
4,592,319 6/1986 Meistrick ..... 123/321
4,741,307 5/1988 Menoely ..... 123/321
5,036,810 8/1991 Undonnely ..... 123/321

*Primary Examiner*—Raymond A. Nelli
*Attorney, Agent, or Firm*—Robert R. Jackson

[57] ABSTRACT

An improved master piston assembly for use in a compression release engine retarder. The improved master piston provides increased reliability and reduced manufacturing costs due to a reduction in complexity over the prior art, as well as a redesigned type of contact between the master piston and the associated push rod or rocker arm.

11 Claims, 4 Drawing Sheets

MASTER PISTON FOR A COMPRESSION RELEASE ENGINE RETARDER

BACKGROUND OF THE INVENTION

This invention relates to engine retarders of the compression release type. More particularly, the invention relates to an improved master piston for a compression release engine retarder.

Engine retarders of the compression release type are well-known in the art. In general, such retarders are designed temporarily to convert an internal combustion engine into an air compressor so as to develop a retarding horsepower which may be a substantial portion of the operating horsepower normally developed by the engine in its powering mode.

The basic design of the compression release engine retarder is disclosed in Cummins U.S. Pat. No. 3,220,392. That design employs a hydraulic system wherein the motion of a master piston actuated by an intake, exhaust, or injector pushrod or rocker arm of the associated engine controls the motion of a slave piston which, in turn, opens the exhaust valve in an engine cylinder whose piston is near its top dead center position. As a result, the work done during the compression stroke of the engine piston is not recovered during the subsequent expansion or power stroke but, instead, is dissipated through the engine exhaust and cooling systems.

Heretofore, mast pistons have been complex assemblies that are costly to manufacture and are subject to wear and/or cause wear on the engine surface in contact with them. The rounded surface that makes contact with the pushrod or rocker arm is difficult and expensive to manufacture. In addition, the line contact between the master piston and the pushrod or rocker arm causes high stress at the contact line, which increases wear of the master piston and the pushrod or rocker arm. In addition, the prior art design of the return spring requires a hole to be bored into the piston for placement of the return spring, after which, the hole is closed with a threaded plug. The complex process required for the manufacture of the contact surface and the return spring cavity is very costly.

In view of the foregoing, it is an object of this invention to simplify the design of master pistons for compression release engine retarders, thereby reducing the manufacturing requirements and cost. It is a further object of this invention to improve the design of the contact region and return spring of master pistons to reduce cost and wear.

SUMMARY OF THE INVENTION

These and other objects of the invention are accomplished in accordance with the principles of the invention by providing an improved master piston which can be manufactured without any complex surfaces or assemblies. The installation of the return spring is simplified to no longer require a bored cavity within the piston body, nor a threaded plug to close that cavity. The master piston contact region is separated from the master piston body and modified to provide automatic alignment between the master piston and the associated push rod or rocker arm, thereby eliminating the need for an anti-rotation pin. Additionally, the contact region is modified to provide increased contact area, thereby reducing contact stress between the master piston and the push rod or rocker arm.

Further features of the invention, its nature and various advantages will be more apparent from the accompanying drawings and the following detailed description of the preferred embodiments.

DETAILED DESCRIPTION OF THE PREFERRED EMBODIMENTS

Figure 1:
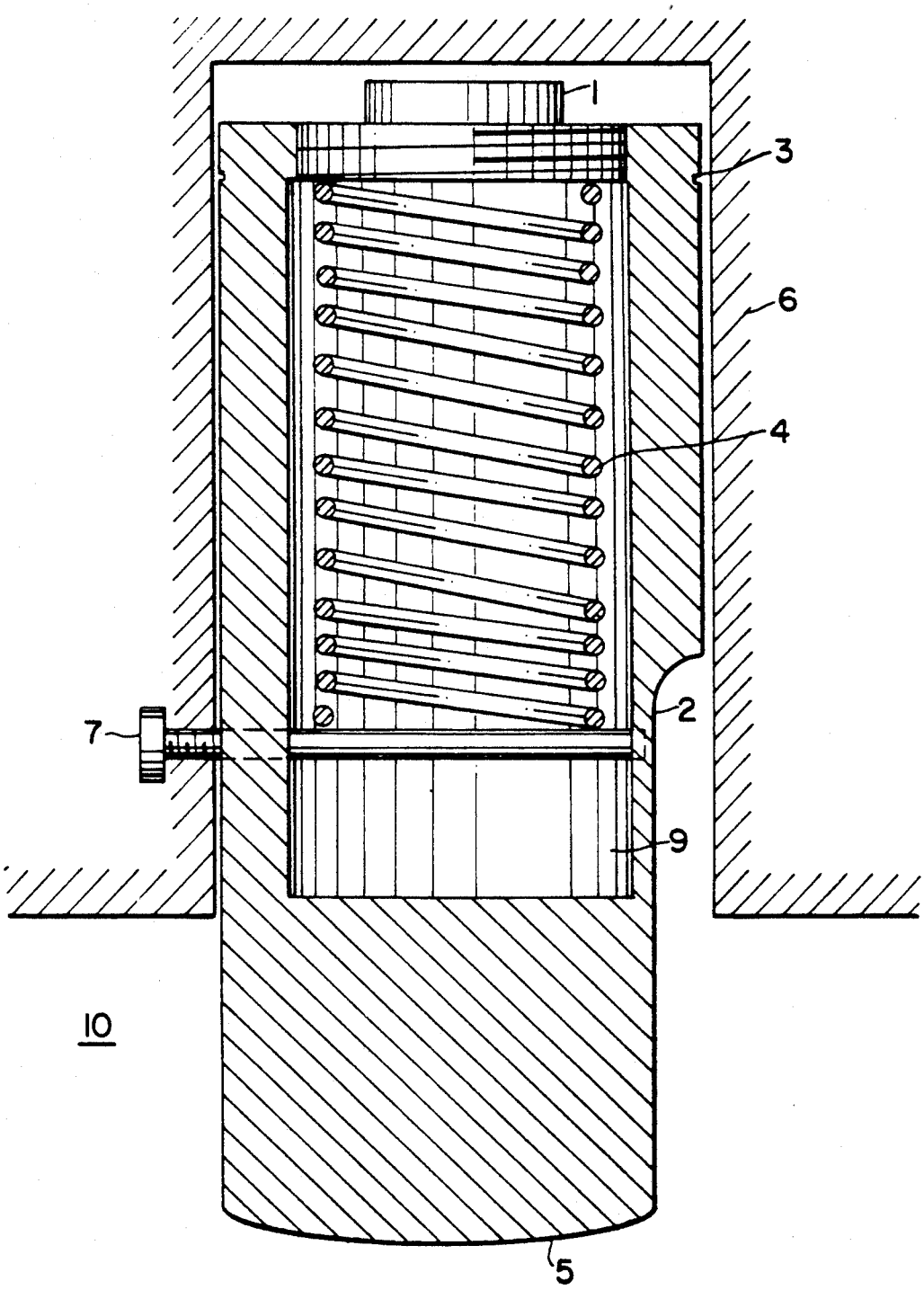
FIG. 1 PRIOR ART
FIG. 1 is a simplified elevation view, partly in section, of a prior art master piston assembly.
Figure 2:
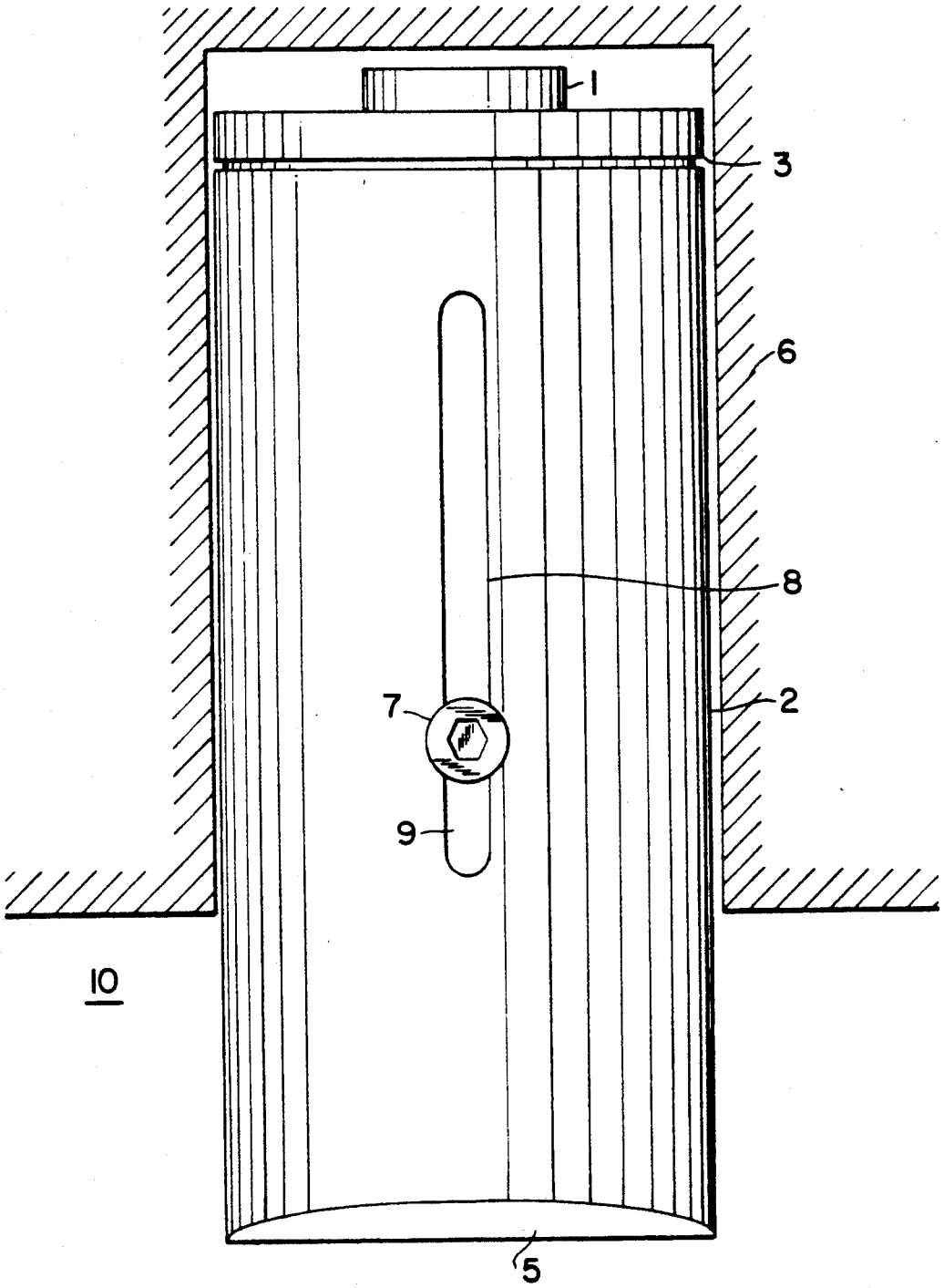
FIG. 2 PRIOR ART
FIG. 2 is another view similar to FIG. 1 showing the apparatus of FIG. 1 rotated 90° about a vertical axis.

FIGS. 1 and 2 show a typical prior art master piston assembly 10, which comprises master piston body 2, threaded plug 1, balancing groove 3 (which tends to evenly distribute hydraulic pressure to keep master piston assembly 10 concentric in master piston cylinder 6), return spring 4 located within cavity 9 of master piston body 2, and anti-rotation pin 7. Master piston assembly 10 is shown in its condition when the engine brake is off and therefore return spring 4 alone controls the vertical position of body 2 in cylinder 6. Anti-rotation pin 7 provides three functions to master piston assembly 10, the first of which is to keep master piston assembly 10 within master piston cylinder 6. The second function of anti-rotation pin 7 is to prevent master piston assembly 10 from rotating within master piston cylinder 6. This could cause curved contact surface 5 to become improperly oriented with respect to the surface of the engine push rod or rocker arm (not shown) on which surface 5 bears when the compression release engine brake is in operation. The final function of anti-rotation pin 7 is to restrict expansion of prestressed compression coil return spring 4.

In manufacturing the above assembly, there are various processes that increase the cost of manufacturing. Contact surface 5 is a rounded surface that is difficult to manufacture and therefore expensive. The shaping of master piston body 2 to receive anti-rotation pin 7 in elongated slot 8 is also expensive, as is the process of boring master piston body 2 to create cavity 9 for insertion of return spring 4. Assembly of master piston assembly 10 requires that return spring 4 be inserted into cavity 9, followed by screwing threaded plug 1 into master piston body 2. This completed assembly is then inserted into master piston cylinder 6 and anti-rotation pin 7 must then be screwed through cylinder 6 and slot 8 into piston body 2. This relatively complex assembly process further increases manufacturing cost.

In addition to increased manufacturing cost, rounded contact surface 5 makes a line contact with an associated push rod or rocker arm as mentioned above to receive engine timing inputs. Such a line contact provides a contact region between master piston assembly 10 and the associated push rod or rocker arm which is a relatively small area. This small contact area tends to promote wear of the master piston and/or the push rod or rocker arm.

Figure 3:
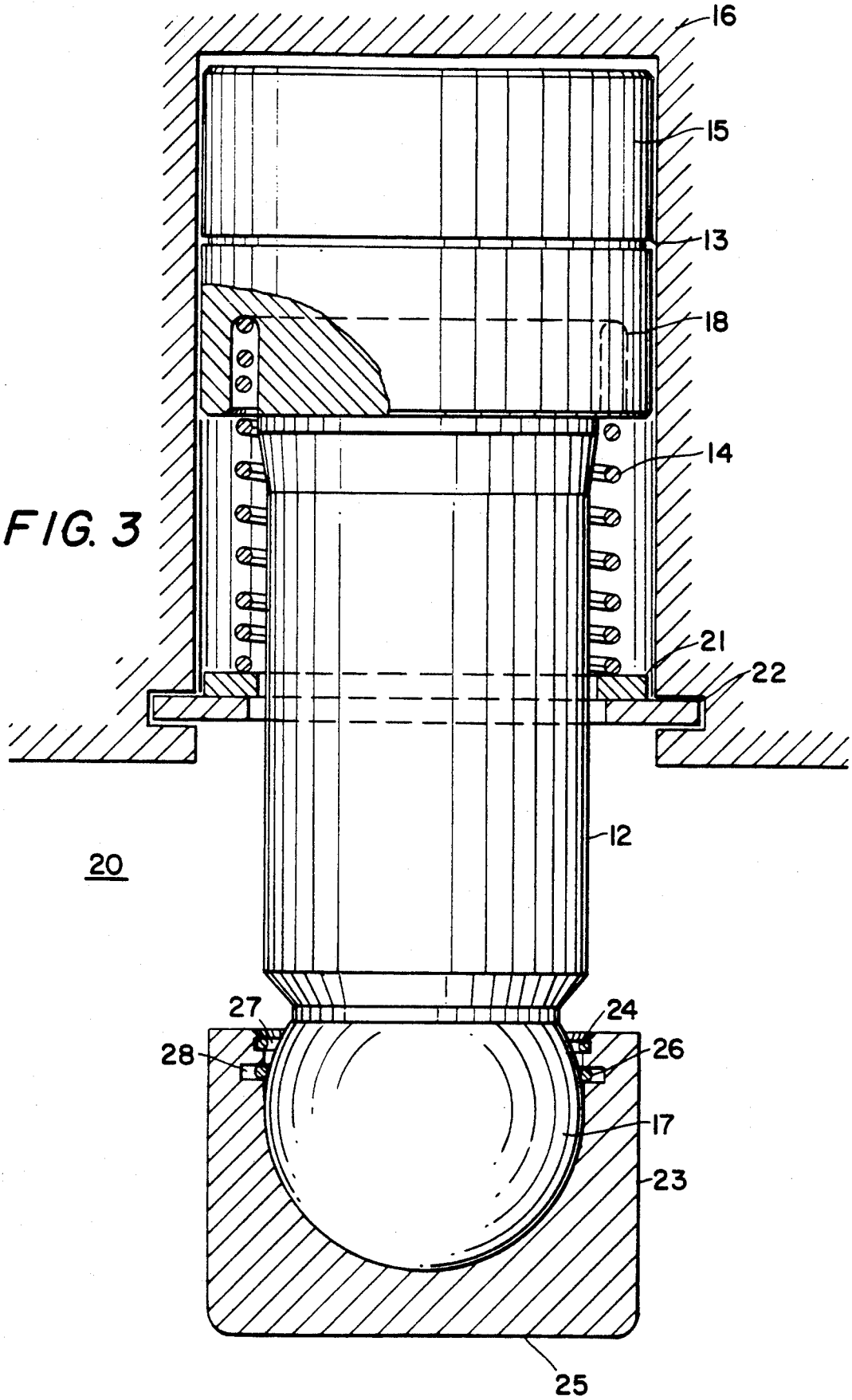
FIG. 3 is a simplified elevation view, partly in section, of an illustrative embodiment of the invention before contact with a rocker arm or other mechanical input element.
Figure 4:
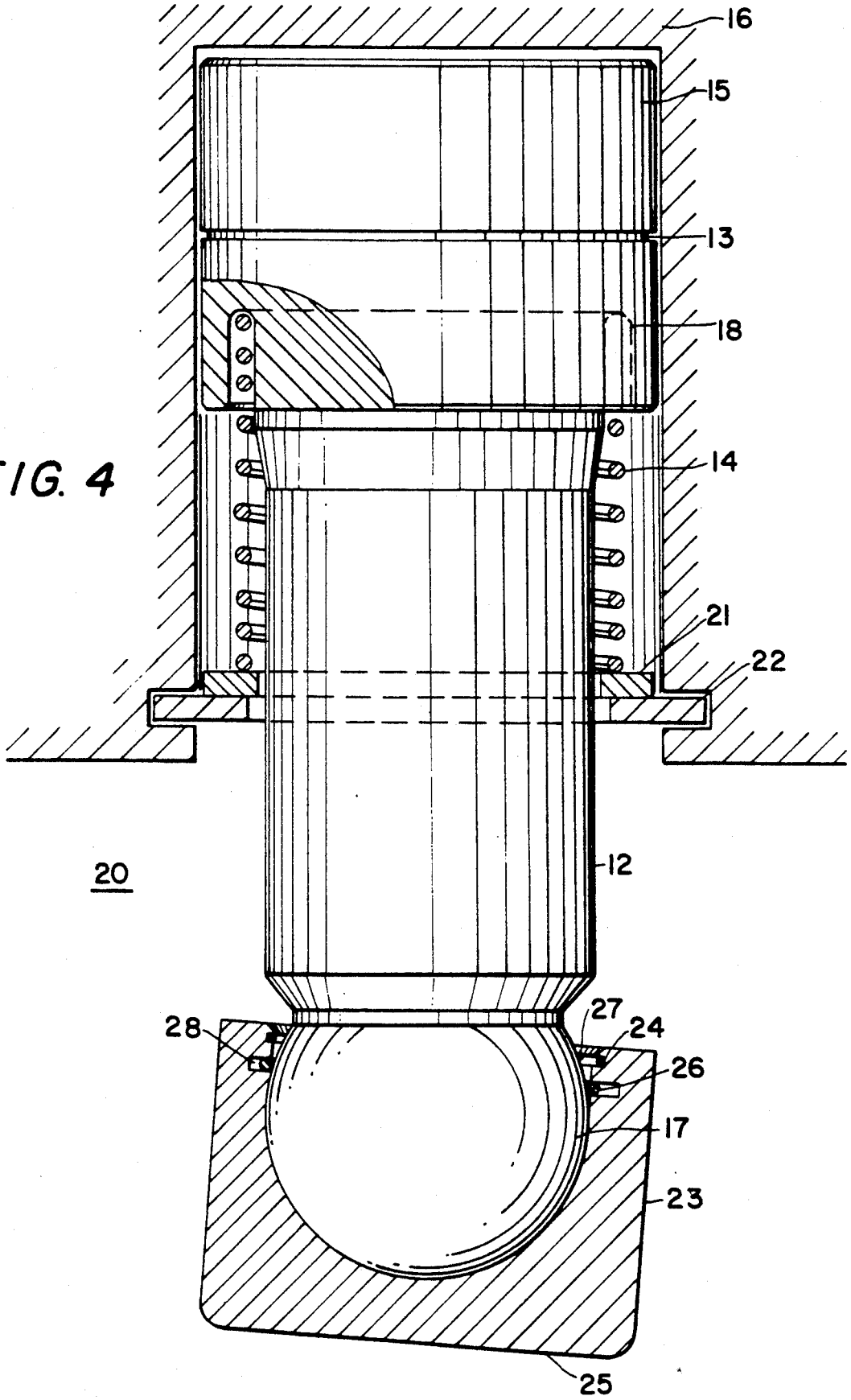
FIG. 4 is a view similar to FIG. 3 showing the apparatus of FIG. 3 after contact with a rocker arm or other mechanical input element.

In the illustrative embodiment of the present invention shown in FIGS. 3 and 4, master piston assembly 20 comprises master piston body 12, return spring 14, and foot 23. Master piston assembly 20 is again shown in its condition when the engine brake is off so that the position of body 12 is determined entirely by return spring 14. Master piston body 12 comprises at one end piston head 15 having annular balancing groove 13 (which tends to evenly distribute hydraulic pressure to keep master piston assembly 20 concentric in master piston cylinder 16) and at the other end spherical ball joint 17. Return spring 14 is a prestressed compression coil spring having one end in annular channel 18 and the other end abutting washer 21 which is held in place by snap ring 22.

Foot 23 is a cylindrical object with a closed end and an open end which can swivel on ball joint 17. (By "swivel" it is meant that foot 23 can both pivot and rotate with respect to ball joint 17.) The closed end of foot 23 has an exterior flat contact surface 25 and an interior spherical surface which complements the surface of ball joint 17. There are two annular slots 27 and 28 located adjacent the open end of foot 23. The foremost slot 27 holds retainer 24 which is a prestressed split ring spring, biased radially outward against the bottom of slot 27 to prevent detachment of foot 23 from ball joint 17. The lower slot 28 holds retention spring 26 which is also a prestressed split ring spring, but is biased radially inward against ball joint 17 to retain the angular alignment of foot 23 with the associated push rod or rocker arm after the compression release engine retarder has been turned off and return spring 14 lifts the master piston out of contact with the push rod or rocker arm. Master piston assembly 20 provides improvement over master piston assembly 10 in many ways as will be shown below.

In order to reduce manufacturing costs, contact surface 25 has been removed from master piston body 12 and redesigned. Contact surface 25 is now a flat surface, which is easier to manufacture than curved contact surface 5 on master piston body 2, and therefore less costly. The improved design of contact surface 25 eliminates the need to prevent rotation of master piston assembly 20 within master piston cylinder 16, thereby eliminating one of the needs for an anti-rotation pin. Another improvement with respect to manufacturing is the installation of return spring 14 into master piston assembly 20. Unlike master piston assembly 10, the installation of return spring 14 does not require the additional manufacturing steps of boring a cavity into a master piston body and screwing a threaded plug into the master piston body. Return spring 14 is installed into channel 18 during installation of master piston body 12 into master piston cylinder 16, and is held in place by washer 21 and snap ring 22 which snaps into an annular slot in the wall of master piston cylinder 16. The new installation of return spring 14 eliminates the remaining need for an anti-rotation pin and its associated elongated slot, thereby further reducing manufacturing and assembly costs.

Master piston assembly 20 also provides an increase in reliability over master piston assembly 10 by eliminating the anti-rotation pin which may be subject to shear failure. FIG. 4 illustrates a further improvement in reliability showing the functionality of redesigned contact surface 25. Master piston assembly 20 provides a flat contact surface 25, thereby increasing the area of contact with the associated push rod or rocker arm. Flat contact surface 25 reduces contact stress between master piston assembly 20 and the push rod or rocker arm, thereby reducing wear on both components. Master piston assembly 10 requires a curved contact surface 5 to maintain alignment with the associated push rod or rocker arm. Master piston assembly 20 uses retention spring 26 to hold foot 23 in position (as shown in FIG. 4) after the compression release engine retarder has been turned off and return spring 14 has removed master piston assembly 20 from contact with the push rod or rocker arm. Foot 23 is therefore in the proper position for contacting the push rod or rocker arm when the engine retarder is turned on again.

It will be understood that the foregoing is merely illustrative of the principles of this invention, and that various modifications can be made by those skilled in the art without departing from the scope and spirit of the invention. For example, a different size foot providing increased or reduced surface area can easily be installed to accommodate different engine configurations, push rods, or rocker arms.

The Invention claimed Is:

1. A master piston assembly for use in a compression relief engine retarder comprising:

a piston member having a piston head at one end, a substantially spherical surface at the end remote from said piston, and a shaft portion extending from said piston head to said substantially spherical surface, said piston head having a diameter which is larger than the transverse dimension of said shaft portion; and a foot member swivelly mounted on said substantially spherical surface for contacting a component of an engine associated with said compression relief engine retarder which provides a mechanical input for operating the master piston assembly when the compression relief engine retarder is in operation.

2. The apparatus defined in claim 1 further comprising means for resiliently urging said piston member to move in the direction of said piston head relative to a master piston cylinder in which said piston member is disposed.

3. The apparatus defined in claim 2 wherein said means for resiliently urging comprises:

a prestressed compression coil spring disposed around said shaft portion.

4. The apparatus defined in claim 3 wherein one end of said prestressed compression coil spring bears on said piston head and the other end of said prestressed compression coil spring acts on said master piston cylinder.

5. The apparatus defined in claim 4 wherein said one end of said prestressed compression coil spring is received in an annular recess in said piston head.

6. The apparatus defined in claim 4 further comprising a snap ring disposed in an annular slot in the wall of said master piston cylinder so that said snap ring projects radially inward from the wall of said cylinder adjacent said shaft portion, and wherein said other end of said prestressed compression coil spring acts on said master piston cylinder via said snap ring.

7. The apparatus defined in claim 6 further comprising a washer interposed between said other end of said prestressed compression coil spring and said snap ring.

8. The apparatus defined in claim 1 further comprising means for resiliently urging said foot member to remain in any swivel position relative to said substantially spherical surface in which said foot member is left after contact with said component of said associated engine.

9. The apparatus defined in claim 8 wherein said means for resiliently urging comprises:

an annular recess in a wall of said foot member adjacent said substantially spherical surface; and a split ring spring disposed in said annular recess and resiliently biased into contact with said spherical surface.

10. A master piston assembly for use in a compression relief engine retarder comprising:

a piston body having at one end, a piston head with a front and a back having a bored axially extending annular channel, and a ball joint at a second end;

a washer;

a snap ring;

a prestressed compression coil return spring with one end located in said channel and another end held in place by said washer, said washer held in placed by said snap ring which holds said master piston assembly in a maser piston cylinder; and a foot attached to said ball joint by a prestressed compression coil retainer spring, said foot having means to self-adjust alignment between said front and an associated engine push rod or rocker arm.

11. The apparatus defined in claim 10 wherein said means to self-adjust alignment comprises:

a prestressed split ring retention spring, inwardly biased against said ball joint to retain said alignment of said foot with respect to said associated engine push rod or rocker arm after said compression release engine retarder has been turned off; and a prestressed split ring retention spring, outwardly biased against said foot to prevent detachment of said foot from said piston body.

* * * * *

UNITED STATES PATENT AND TRADEMARK OFFICE

CERTIFICATE OF CORRECTION

PATENT NO. : 5,165,375

DATED : November 24, 1992

INVENTOR(S) : Haoran Hu

It is certified that error appears in the above-indentified patent and that said Letters Patent is hereby corrected as shown below:

| Column | Line | |
|---|---|---|
| 1 | 31 | Change "mast" to --master--. |
| 5 | 19 | Change "placed" to --place--. |
| 6 | 2 | Change "maser" to --master--. |
| 6 | 5 | Change "front" to --foot--. |

Signed and Sealed this

Nineteenth Day of April, 1994

*Attest:*

*Attesting Officer*

BRUCE LEHMAN

*Commissioner of Patents and Trademarks*